United States Patent [19]

Grosser et al.

[11] 4,274,626

[45] Jun. 23, 1981

[54] EXERCISE FLOOR

[75] Inventors: Richard W. Grosser, Boone; Virgil L. Long, Sr., Jefferson, both of Iowa

[73] Assignee: AMF Incorporated, White Plains, N.Y.

[21] Appl. No.: 34,230

[22] Filed: Apr. 30, 1979

[51] Int. Cl.[3] ..... A63B 5/00; E04F 15/22

[52] U.S. Cl. ..... 272/109; 52/584; 52/402

[58] Field of Search ..... 273/30; 272/3, 56.5 SS, 272/70, 101, 109, 113, 144, 63; 52/126, 396, 403, 476, 480, 485, 486, 489, 573, 582, 584, 586; 5/417, 420

[56] References Cited

U.S. PATENT DOCUMENTS

| | | | |
|---|---|---|---|
| 2,119,327 | 5/1938 | Gunnarson | 272/3 |
| 2,243,943 | 6/1941 | Bunting | 272/3 |
| 2,340,864 | 2/1944 | Carpenter | 52/584 X |
| 2,834,065 | 5/1958 | Mueller | 52/582 |
| 2,855,201 | 10/1958 | Yetton | 272/63 |
| 3,192,574 | 7/1965 | Jaffe et al. | 52/586 X |
| 3,343,324 | 9/1967 | Gordon | 52/403 |
| 3,375,005 | 3/1968 | Cook | 273/30 |
| 3,604,173 | 9/1971 | Dahlborg | 52/480 X |
| 3,859,768 | 1/1975 | Donzis | 272/3 X |
| 3,879,916 | 4/1975 | Bigham | 52/584 X |

FOREIGN PATENT DOCUMENTS

| | | | |
|---|---|---|---|
| 1029233 | 3/1953 | France | 52/584 |
| 61013 | 9/1954 | France | 52/584 |
| 508128 | 6/1939 | United Kingdom | 272/56.5 SS |

*Primary Examiner*—Richard J. Apley

*Attorney, Agent, or Firm*—George W. Price; Walter Lewis

[57] ABSTRACT

4×8 Plywood sections are interconnected by a system of tabs and latches, and a spring suspension system is provided beneath the interconnected sections.

3 Claims, 6 Drawing Figures

EXERCISE FLOOR

This invention relates to an exercise floor, and more particularly to a portable gymnastic exercise floor.

It is an object of this invention to provide a low cost, readily assembled, portable gymnastic exercise floor.

Briefly, in the invention, the above and other objects and advantages are obtained by a plurality of spring suspended, removably interlocked, 4×8 plywood sections.

In the attached two sheets of drawings.

In the invention fifty 4×8 plywood sections are edge butted against each other to provide a 40×40 exercise floor, five sections being arranged lengthwide on one side, and eight sections being arranged crosswise on the other side. Of course, it is possible to use more or less sections, depending upon the size floor desired, and it is also possible to use other than 4×8 sections. However, the latter are preferred since they are readily available from existing lumber stock. That is to say, in order to meet the object of low cost, it is the intent of the invention to use parts or components that are readily available on the marketplace.

Figure 1:
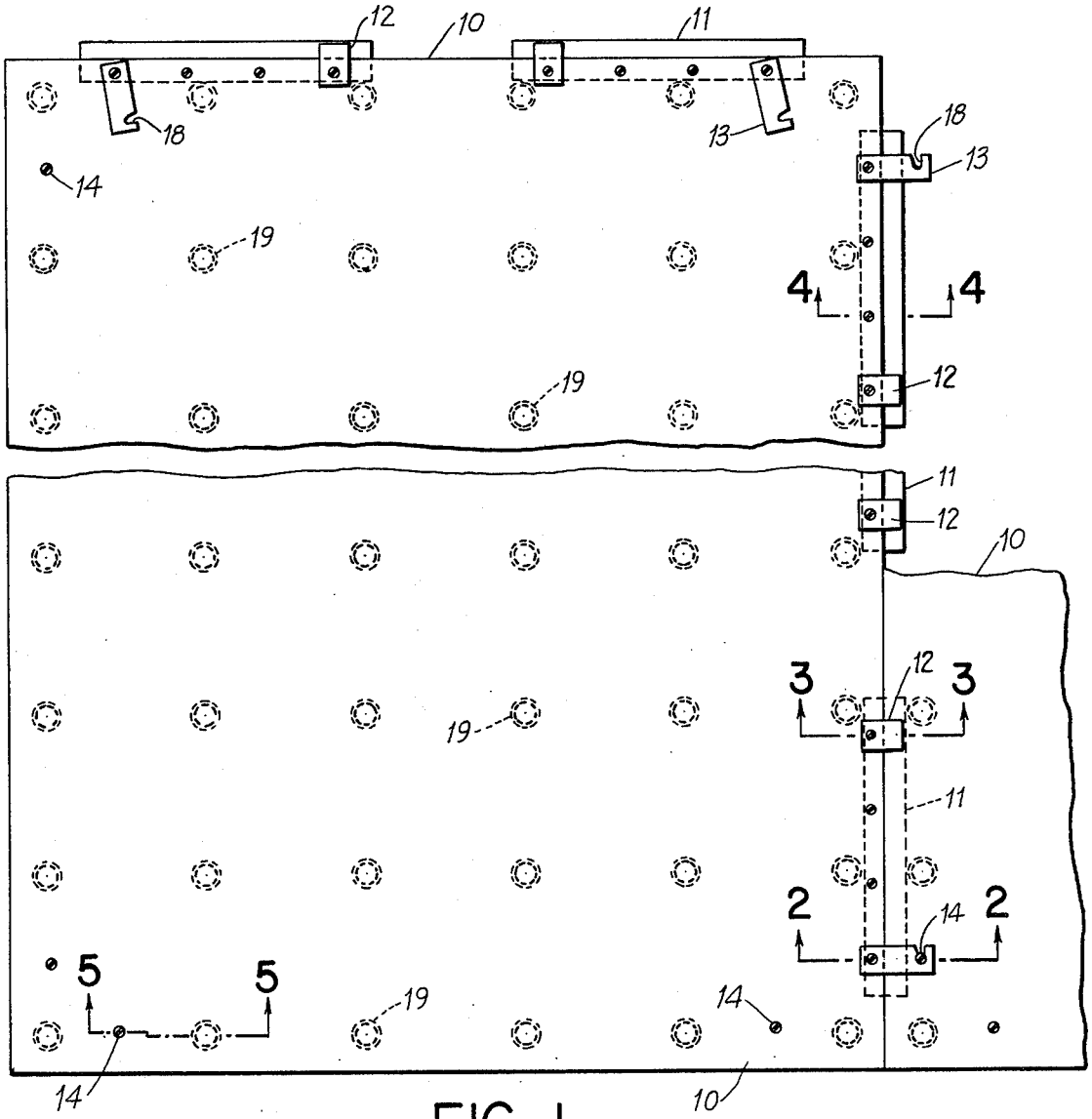
FIG. 1 is a broken away top plan view of a form of the invention.
Figure 3:
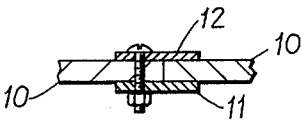
FIGS. 2–5 are cross-sectional views taken along the section lines 2—2 through 5—5 respectively of FIG. 1.
Figure 2:
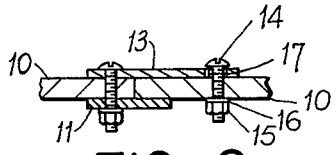
Figure 4:
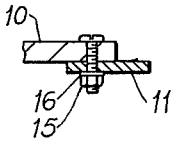
Figure 5:
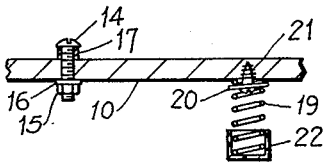
Figure 6:
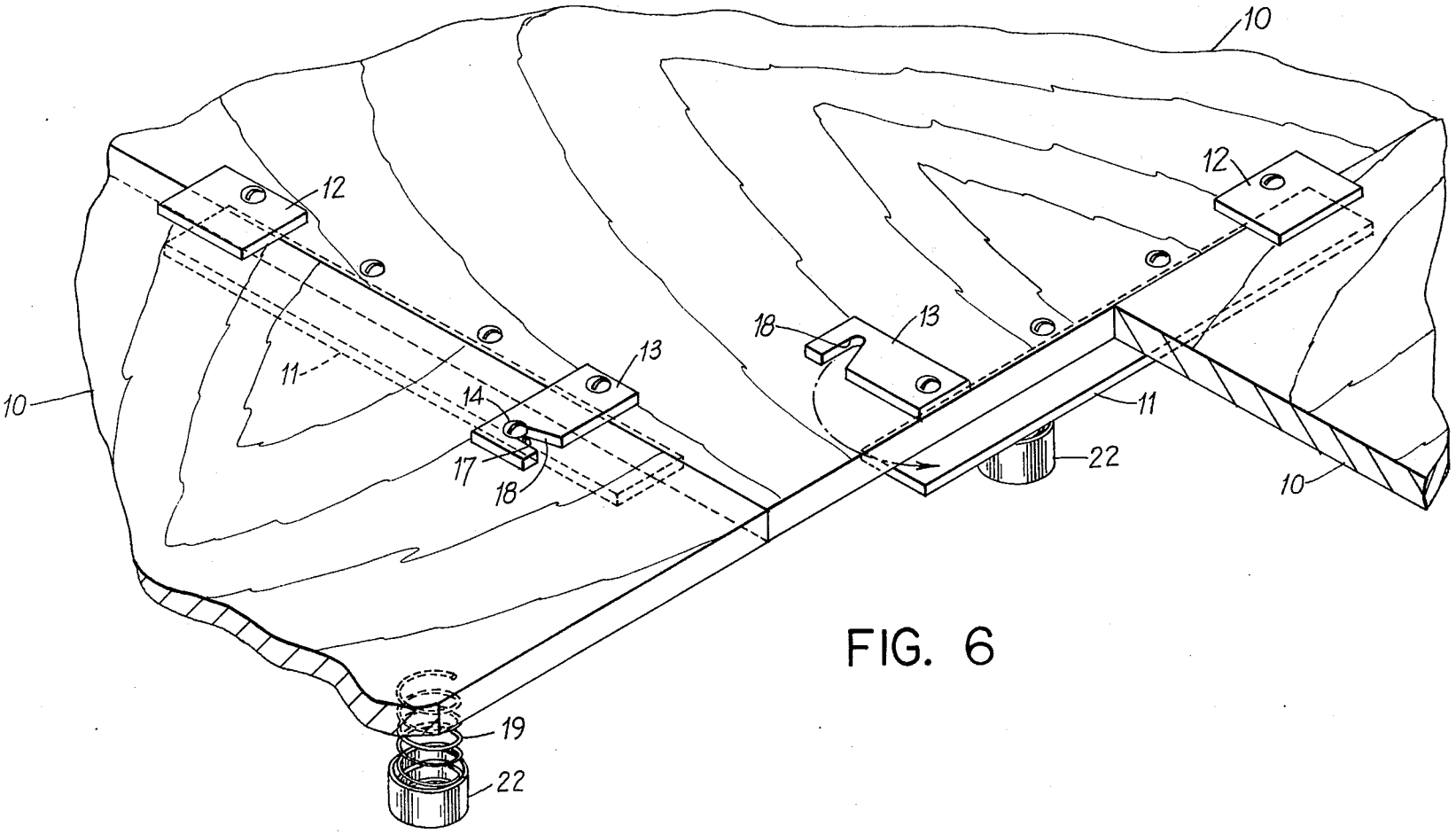
FIG. 6 is an enlarged broken away perspective view of the floor illustrated in FIG. 1.

Turning now specifically to the two sheets of drawings, shown therein are several 4×8 plywood sections 10 which are butted against each other along their edges. One of the abutting edges has connecting strips 11, connecting tabs 12, and latches 13; whereas the other abutting edge has latch posts 14 for the latches 13. The strips 11, tabs 12 and latches 13 are constructed from flat metallic stock. The latch posts 14 comprise threaded studs or bolts with accompanying nuts 15 and plain or spring washers 16. The bolt, nut and washer subassembly 14–16 is also used to connect the parts 11–13 to the boards. In those places where the bolts 14 serve as latch posts for the latches 13, the bolts 14 are provided with bushings 17 at their upper ends, see FIGS. 2 and 5.

The tabs 11 are in the form of elongated strips and they overhang the edges of the boards. The tabs 12 are much shorter, almost square, and they too overhang the board edges but to a lesser amount than the strips 11. This is to facilitate sliding the edge of the adjacent board to in between the spaced strips 11 and tabs 12. The outer ends of the latches 13 have a notch 18 therein to hook the latches on to the latch posts 14. In stored position of the boards, the latches 13 are pivoted about their inner end bolts 14 to non-protruding position. After the edge of one board is inserted to between the tabs 11 and 12 and butted against the edge of that board carrying those tabs, the latch 13 is then swung around to hook on to the latch post 14 of the first board. In order to disassemble the exercise floor it is only necessary to unhook the latches from their latch posts and then separate the boards.

A spring suspension system (see FIG. 5) is provided for the exercise floor. This comprises a plurality of short coil springs 19 beneath the boards. The springs 19 are attached to the boards by concave washers 20 which have a central hole for the purpose of attaching the washers to the boards with a wood screw 21 so that the concave side of the spring retaining washers 20 faces down. The first turn or so of the springs 19 is slipped into the space between the convex side of the washers and the boards so that the washers retain the springs on the underside of the boards. The lower ends of the depending springs are provided with cup-shaped plastic or the like caps 22 so as to not scratch the underlying support surface, such as a regular gymnasium floor.

The depending springs 19 serve as a resilient sound and jolt absorbing cushion for the person exercising on the portable gymnastic spring exercise floor. In addition, lack of uniformity or true flatness in the underlying gymnasium floor will be compensated for by the spring suspension system. In other words, the assembled boards provide a truly flat exercise floor for the exerciser. Although not illustrated, after the boards are assembled together, the outer edges of the floor are framed in or surrounded by a cushion, and pad is laid over the floor. The cushion for the edges can comprise two inch thick foam, and the pad can comprise a one inch thick foam floor mat.

It will now be seen that the invention provides an exercise floor which is portable, readily assembled and disassembled, and also low cost. In addition, the floor can be readily repaired. For example, should one of the boards after long use fatigue or fail, a "do it yourselfer" can easily replace it with a fresh board while still using the old hardware parts merely by drilling the appropriate holes and assembling the hardware. The floor is also easy to transport. This is because there are no loose falling parts, and inasmuch as all the boards are sized the same, they can be compactly stacked and boxed, crated or banded together for shipment.

We claim:

1. A portable gymnastic exercise floor, comprising a plurality of like sized boards which are edge butted and latched together, the butt edge of one of a pair of abutted boards having spaced top and bottom overhanging tabs affixed thereto, the butt edge of the other of said pair of abutted boards being positioned between said tabs, and notched latches along one of said butt edges and latch posts along the other of said butt edges for having said latches hooked thereon to latch said pair of abutted boards together, said boards comprising 4×8 plywood, said tabs and latches comprising flat metallic stock, said latch posts comprising a nut and bolt subassembly, and like nut and bolt subassemblies connecting said tabs and latches to their respective boards.

2. In a portable floor, as in claim 1, including a plurality of short coil springs connected to the underside of said boards for spring suspending said floor off an underlying support surface.

3. In a portable floor, as in claim 1, said 4×8 plywood having a plurality of short coil springs connected to the underside of said plywood whereby said floor is spring suspended off an underlying support surface, the lengthwise axis of said coil springs being positioned perpendicular to the flat plane of said 4×8 plywood, and plastic cup-shaped caps on the bottom ends of said coil springs.

* * * * *